US009567804B2

(12) United States Patent
Youlyahshiev

(10) Patent No.: US 9,567,804 B2
(45) Date of Patent: Feb. 14, 2017

(54) LADDER HOLDER

(71) Applicant: City of Regina, Regina (CA)

(72) Inventor: Bahodir Youlyahshiev, Regina (CA)

(73) Assignee: CITY OF REGINA, Regina, Saskatchewan (CA)

( * ) Notice: Subject to any disclaimer, the term of this patent is extended or adjusted under 35 U.S.C. 154(b) by 0 days.

(21) Appl. No.: 14/536,876

(22) Filed: Nov. 10, 2014

(65) Prior Publication Data

US 2016/0108670 A1 Apr. 21, 2016

(51) Int. Cl.
*E06C 1/36* (2006.01)
*E06C 7/48* (2006.01)

(52) U.S. Cl.
CPC .. *E06C 1/36* (2013.01); *E06C 7/48* (2013.01)

(58) Field of Classification Search
CPC ..... E06C 1/36; E06C 1/34; E06C 7/00; E06C 7/06; E06C 7/48; E06C 7/482; E06C 7/484; E06C 7/486; E06C 7/505
See application file for complete search history.

(56) References Cited

U.S. PATENT DOCUMENTS 966,244 A * 8/1910 Ruck ..... E06C 7/16 248/238
1,018,877 A * 2/1912 Chickering ..... E06C 1/36 182/206
2,963,104 A * 12/1960 Roth ..... E06C 1/36 182/129
3,318,416 A * 5/1967 Robinson ..... E06C 1/345 182/111
3,606,226 A * 9/1971 Bell ..... E06C 1/345 182/206
5,181,683 A * 1/1993 Smith ..... A01K 39/01 248/231.31
5,388,665 A * 2/1995 Newman ..... E06C 7/16 182/118
6,044,930 A * 4/2000 Hayman ..... E06C 7/48 182/107
6,158,549 A * 12/2000 Hartman, Jr. ..... E06C 7/48 182/206
6,533,069 B1 * 3/2003 Couillard ..... E06C 1/34 182/107
7,219,766 B2 * 5/2007 Deuer ..... E06C 1/36 182/10
7,845,468 B2 12/2010 Steblinski
(Continued)

*Primary Examiner* — Alvin Chin-Shue
*Assistant Examiner* — Shiref Mekhaeil
(74) *Attorney, Agent, or Firm* — Ryan W. Dupuis; Kyle R. Satterthwaite; Ade & Company Inc

(57) ABSTRACT

A ladder holder for mounting a ladder in an upright orientation relative to a retaining wall is disclosed. The holder includes a mounting portion for coupling in fixed relation to the wall in a mounted position and a support portion supported fixedly on the mounting portion. The mounting portion has a first clamping surface and a second clamping surface that is moveable relative to the first clamping surface. The first and second clamping surfaces frictionally engage the inner and outer surfaces of the top beam of the retaining wall. The support portion has upper and lower rung-receiving slots used in conjunction to mount the ladder on the support portion at a fixed angle relative to the mounting portion. Furthermore, the storage slot suspends the ladder vertically from the support portion independently of the upper and lower slots.

16 Claims, 7 Drawing Sheets

(56) References Cited

U.S. PATENT DOCUMENTS

| | | | | |
|---|---|---|---|---|
| 9,022,172 | B2 * | 5/2015 | McCarthy | E06C 1/345 182/129 |
| 2007/0068732 | A1 * | 3/2007 | Nagle | E06C 7/16 182/121 |
| 2011/0158783 | A1 * | 6/2011 | Carlson | E06C 1/36 414/800 |

* cited by examiner

LADDER HOLDER

This application claims foreign priority benefits from Canadian Patent Application 2,868,564 filed Oct. 17, 2014.

FIELD OF THE INVENTION

The present invention relates to a ladder holder of the type having a mounting portion for mounting onto a supporting objecting and rung slots to receive rungs of a ladder therein to support the ladder, and more particularly the present invention relates to a ladder holder in which: i) the mounting portion is adapted to mount onto an retaining wall typically found in excavation sites; ii) the rung slots support the ladder at a fixed prescribed angle; and iii) the rung slots include both working slots to support the ladder at the prescribed angle and a storage slot independent of the working slots to suspend the ladder therefrom in a vertical storage position.

BACKGROUND

The disclosed invention is a ladder holder for mounting a ladder relative to a retaining wall typically used in ground excavation. Retaining walls are a common sight in urban construction sites because it is vital to protect the workers working in these sites from the collapse of the surrounding ground. As with any construction site, an access means is needed in order to facilitate the access of workers and equipment into the site. Due to the lack of room in the site, ladders are predominantly used as opposed to more mechanized alternatives such as elevators. However, ladders cannot be used without some way of supporting the ladder or attaching it somewhat fixedly to a stable part of the excavation site. This is partly due to the fact that the ground at the bottom of the site is likely uneven, so using the ground to support the ladder is neither reliable nor safe. One available structure to which the ladder can be attached and supported safely is one of the retaining walls. In addition to a stable and safe means of supporting the ladder, another important consideration to make is to ensure that the ladder can be stowed when not in use to afford more space in the site. Furthermore, a valuable feature of such a mounting device would facilitate a worker inside or outside the site to return the ladder to a working position.

Prior art examples describing ladder hooks that could potentially be used to fix a ladder relative to a retaining wall include U.S. Patent Publication No. 2011/0158783 to Carlson, U.S. Pat. No. 1,018,877 to Chickering, and U.S. Pat. No. 7,845,468 given to Steblinski. However, the ladder holders described by these patents have some drawbacks. Firstly, the prior patents do not include a means of guiding a proper angle of the ladder relative to the retaining wall. It is important for the ladder to be supported at an angle relative to the wall so as to afford safer access into and out of the site and to ease the carrying of equipment up and down the ladder. The patent publication for Carlson describes a ladder system with two rung supports that may allow for the ladder to be supported at an angle; however, the upper rung receptacle does not engage its respective rung in such a way that will prevent any lateral movement towards or away from the bar to which the support brackets are attached. As such, the angle of the ladder will not remain fixed relative to the mounting portion of the device. Also, Chickering's patent has two slots with an attachment hook at the upper end of the device that couples the ladder hook to a wall. Nevertheless, the attachment hook does not allow the device to be arranged at a fixed angle relative to an attachment surface. Furthermore, the patent granted to Steblinski uses a single rung supporting element with a flange at the free end of the rung supporting element to position the ladder at an angle to the attachment surface; however, this configuration affords the ladder little stability when positioned at an angle due to the reliance on a narrow flange to prop the ladder against the wall at an angle. A second shortcoming is that the prior art examples do not provide a secure means of stowing the ladder when not in use, so as to reduce the risk of the ladder being knocked off the device by a worker in the site. While the patent given to Steblinski affords the ability to suspend the ladder vertically when not in use, the storage mechanism does not restrict the movement of the ladder when in its storage position so that the ladder can be knocked out of place with little effort by pushing the ladder upwards. Lastly, the prior art examples do not describe a ladder holder that is able to mount to a retaining wall, which is unique in its structure because it contains a corrugated panel and a beam spanning the top edge of the wall that has edges extending beyond the panel on either side thereof. The corrugated panel may be problematic as the corrugations may limit the locations where the device can be stably mounted, while the beam necessitates an attachment or retaining mechanism that must fit a non-uniform structure (i.e., the entire retaining wall).

SUMMARY OF THE INVENTION

According to one aspect of the invention there is provided a ladder holder for mounting a ladder in an upright orientation relative to a wall. The wall has an inner surface lying in a vertical plane and an opposite outer surface. The ladder has two rails extending longitudinally and a plurality of rungs spanning laterally between the rails at uniform longitudinal intervals. Further, the holder comprises a mounting portion arranged for coupling in fixed relation to the wall in a mounted position and a support portion supported fixedly on the mounting portion. The support portion has an upper slot arranged to receive one rung and a lower slot arranged to another rung. The lower slot is positioned below the upper slot and further away from the vertical plane of the inner surface of the wall than the upper slot such that the support portion is arranged for mounting the ladder thereon at a fixed angle relative to the mounting portion in the mounted position.

The present invention provides a means of guiding a proper angle of the ladder relative to the wall because of the fixed position of the lower slot relative to the upper slot, which fixes the angle of the ladder relative to the wall. Furthermore, the support portion containing these slots is supported fixedly on the mounting portion, so as to maintain the ladder at the fixed angle when the ladder is mounted to the holder.

Preferably, the mounting portion comprises a front side portion having a wall engaging surface arranged to engage the inner surface of the wall, a backside portion arranged to engage the outer surface of the wall, and an upper portion arranged to couple the front side portion and the backside portion over an uppermost edge of the wall in the mounted position. The wall engaging surface preferably comprises at least one continuous surface spanning laterally across a full width of the mounting portion. In some instances, the continuous surface is two lateral cross members spaced vertically from one another.

The mounting portion preferably comprises a retaining mechanism for preventing upward lifting in the mounted position. The mounting portion preferably has a front side portion having a first clamping surface arranged to engage the inner surface of the wall and an opposing backside portion supporting a second clamping surface that is moveable with respect to the first clamping surface and is arranged to engage the outer surface of the wall in the mounted position. Collectively, the first and second clamping surfaces define the retaining mechanism. In some instances, the second clamping surface is defined by two screws laterally spaced and threaded through the backside portion.

When the wall is a retaining wall used in ground excavation and has a top beam at an uppermost edge of the wall, the mounting portion may also include a lip protruding from the backside portion towards the front side portion spaced below the upper portion.

Preferably, the support portion further comprises a storage slot independent of the upper and lower slots arranged to receive any one of the rungs such that the support portion is arranged to suspend the ladder substantially vertically therefrom in a storage position. When the retaining wall has a laterally disposed elongate support bracket below a top beam at an uppermost edge of the wall such that the support bracket has a ladder-side surface facing away from the inner surface of the retaining wall, it is preferred that the storage slot is arranged at a distance from the vertical plane of the inner surface of the wall proximate the distance between the ladder-side surface of the support bracket and the inner surface of the wall such that rearward surfaces of the two rails substantially overlap the ladder-side surface in the storage position. In addition, the support portion further comprises two laterally extending guide surfaces being substantially parallel to the wall engaging surface such that the guide surfaces are arranged to engage the two rails of the ladder in the storage position.

It is preferred that the upper and lower slots each comprise an elongated slot and that the elongated slots lie in a common plane at the fixed angle relative to the wall engaging surface. Each of the elongated slots preferably extend from a terminal end at a bottom of the elongated slot to an opening at a top of the elongated slot. Furthermore, one of the upper and lower slots preferably has an upper portion vertically aligned with the storage slot such that the upper portion is arranged to receive another rung in the storage position. In most instances, this upper portion is part of the lower slot. It is preferred that the upper portion has a front engaging surface and an opposite rear engaging surface, the front and rear engaging surfaces being arranged to restrict the movement of the rung restricted by the upper portion in a direction substantially at a right angle towards or away from the inner surface of the wall.

Preferably, the support portion also includes two laterally extending guide surfaces at the fixed angle relative to the wall engaging surface such that the guide surfaces are arranged to engage the two rails of the ladder when the upper and lower slots receive any two rungs of the ladder.

The support portion preferably comprises two laterally opposed side plates. Under this circumstance, each one of the upper and lower slots preferably comprises an individual slot in each side plate.

According to a second aspect of the invention there is provided a ladder in an upright orientation relative to a wall having an inner surface lying in a vertical plane. The ladder has two rails extending longitudinally and a plurality of rungs spanning laterally between the rails at uniform longitudinal intervals. The holder further comprises a mounting portion arranged for coupling to the wall in a mounted position and a support portion supported on the mounting portion. The support portion has an upper slot arranged to receive a first rung and a lower slot arranged to receive a second rung such that the support portion is arranged for mounting the ladder at an incline relative to the wall in a working position of the ladder. The support portion also includes a storage slot independent of the upper and lower slots arranged to receive any one of the rungs such that the support portion is arranged to suspend the ladder substantially vertically in a storage position of the ladder.

The invention according to the second aspect solves the problem of stowing the ladder securely when not in use because the present invention provides an independent slot for suspending the ladder vertically, not relying on frictional engagement of a surface which is not specifically shaped to receive a rung. The storage slot is arranged to receive the rung such that the ladder can only be removed from the storage position with the application of sufficient force to intentionally lift the ladder up and out of the storage slot.

According to a third aspect of the invention there is provided a ladder holder for mounting a ladder in an upright orientation relative to a retaining wall used in ground excavation having a top beam at an uppermost edge of the retaining wall. The top beam has an inner surface and an opposite outer surface. The ladder has two rails extending longitudinally and a plurality of rungs spanning laterally between the rails at uniform longitudinal intervals. The holder comprises a mounting portion arranged for coupling in fixed relation to the retaining wall in the mounted position. The mounting portion includes a front side portion having a first clamping surface arranged to engage the inner surface of the wall and an opposing backside portion supporting a second clamping surface that is moveable with respect to the first clamping surface and is arranged to engage the outer surface of the wall. The holder further comprises a support portion supported fixedly on the mounting portion, and the support portion has at least one slot arranged to receive any one of the rungs.

The invention according to the third aspect solves the problem of attaching to a retaining wall because the present invention contains a series of clamping surfaces arranged for frictional engagement of the top beam so as to couple the holder to the retaining wall.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
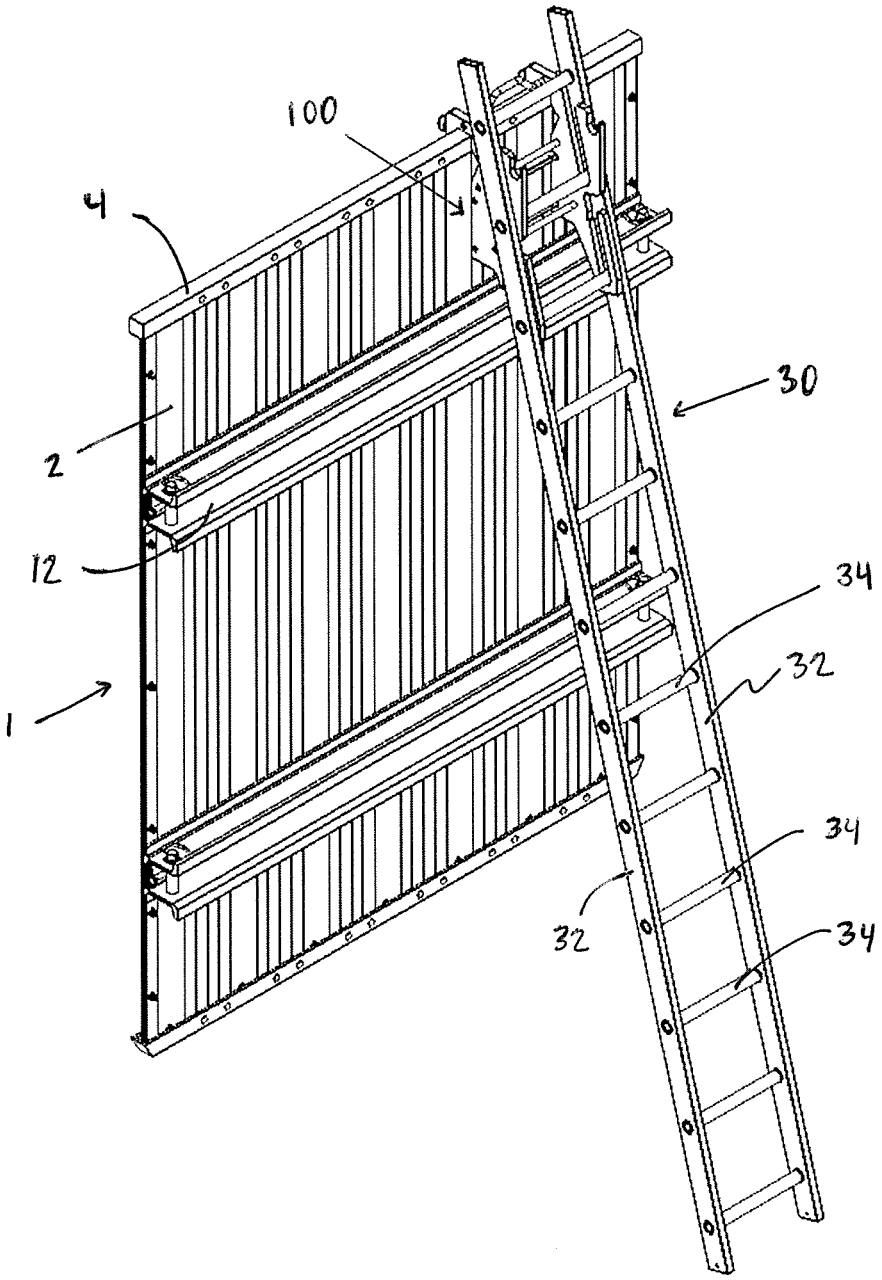
FIG. 1 is a front perspective view of the ladder holder mounted to a retaining wall in the mounted position and supporting a ladder in the working position thereof.
Figure 2:
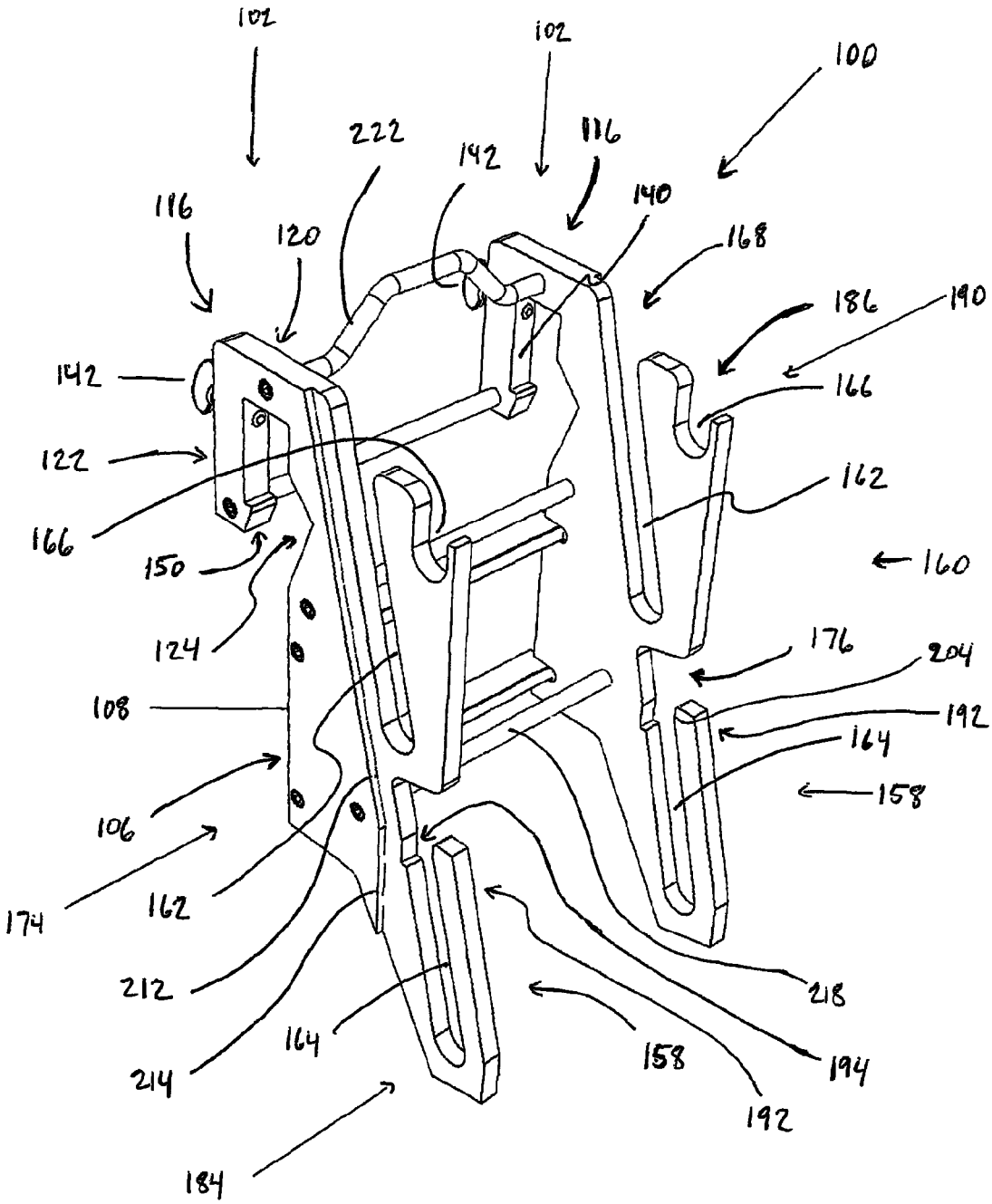
FIG. 2 is a front perspective view of the ladder holder from the left side thereof.
Figure 3:
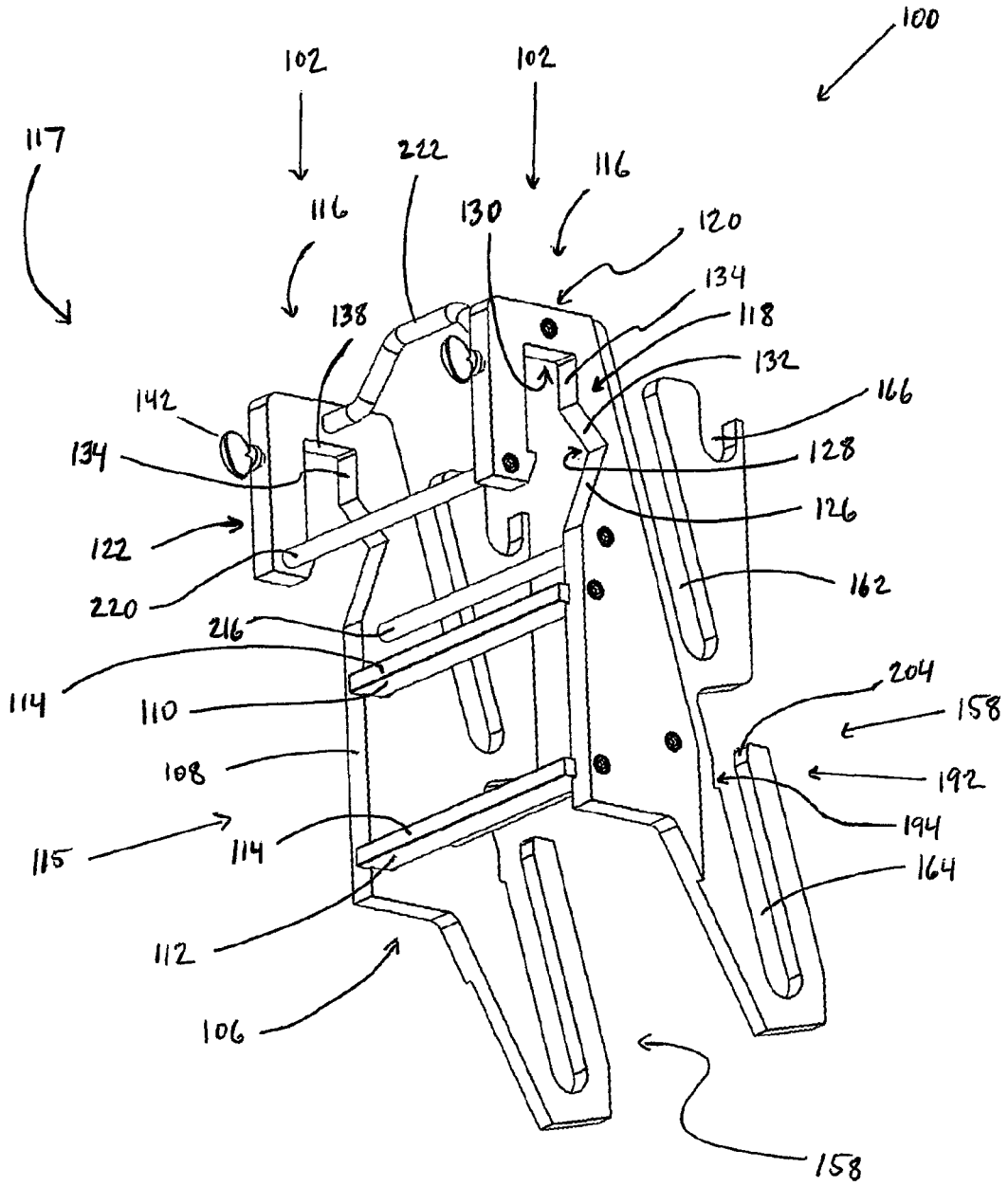
FIG. 3 is a rear perspective view of the ladder holder in FIG. 2 from the left side thereof.
Figure 4:
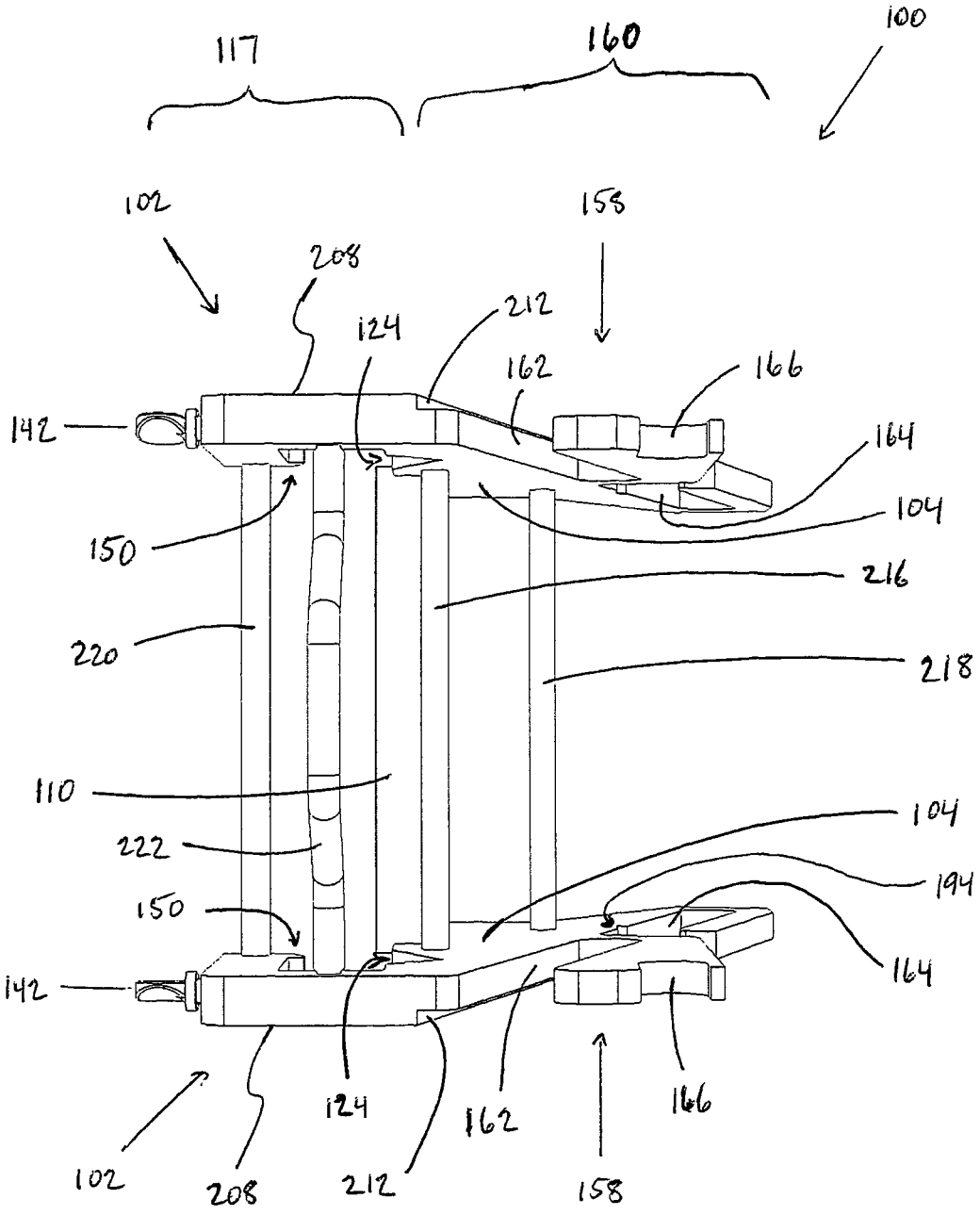
FIG. 4 is a top plan view of the ladder holder in FIG. 2.
Figure 5:
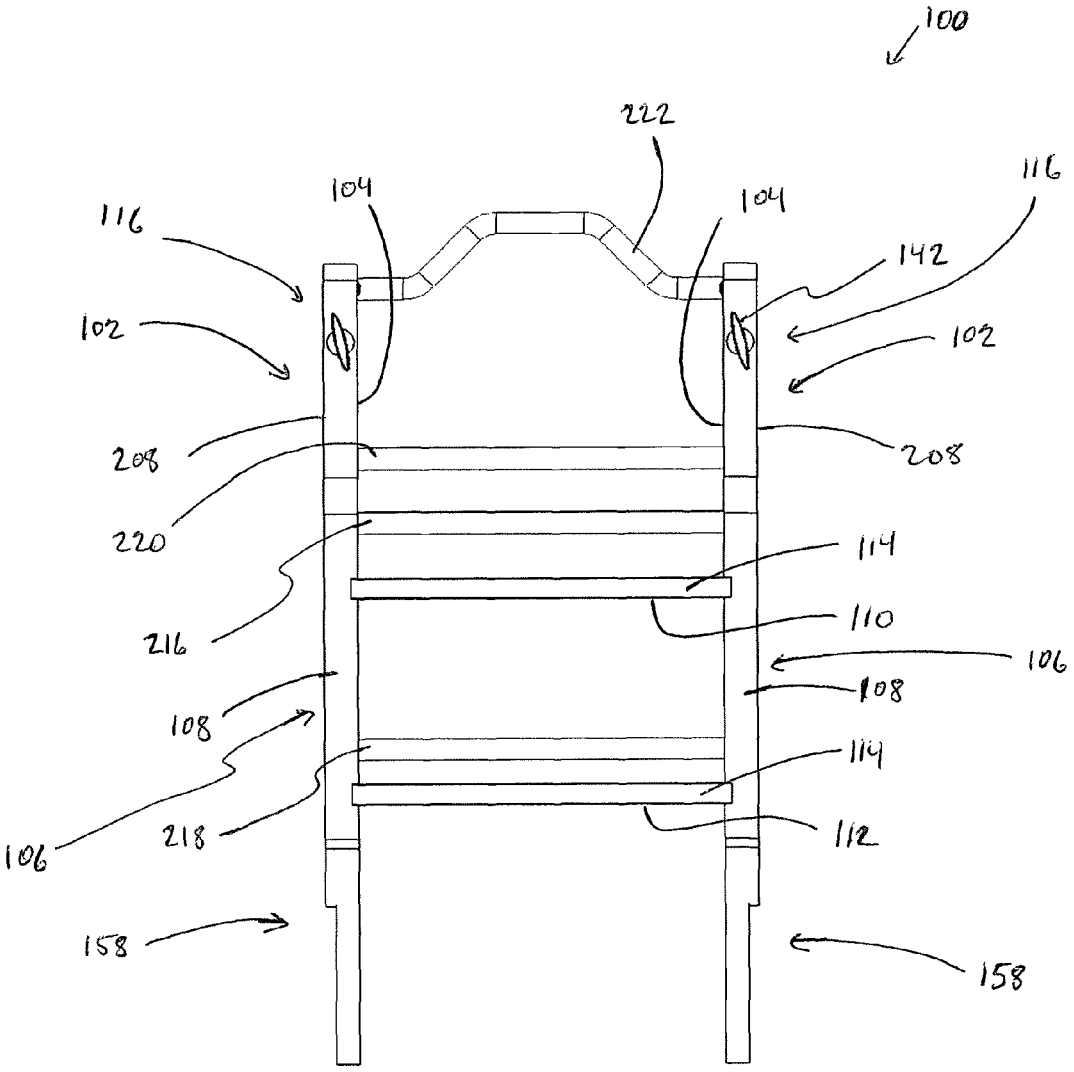
FIG. 5 is a rear elevation view of the ladder holder in FIG. 2.

Referring to the accompanying figures, there is illustrated a ladder holder generally indicated by reference numeral 100 in FIG. 1. The ladder holder 100 is used to mount a ladder 30 in an upright orientation relative to a retaining wall 1 used in excavation sites, which typically includes a corrugated panel 2 and a top beam 4 spanning an uppermost edge of the panel. The depth of the top beam is greater than the thickness of the panel such that bottom edges 6 of the top beam extend beyond the panel on either side thereof. Furthermore, the retaining wall has two surfaces, the first of which is an inner surface 8 lying in a vertical plane that generally faces the excavation site and towards the ladder. The second surface is an outer surface 10 opposite the inner surface that generally faces away from the excavation site. In most cases, the retaining wall also includes a support bracket 12 coupled to the inner surface of the panel below the top beam, to which cross members can be attached to connect opposing retaining walls for added strength of the retaining structure installed in the excavation site.

The ladder 30 in FIG. 1, used to access the excavation site, has two rails 32 extending longitudinally and a plurality of rungs 34 spanning laterally between the rails at uniform longitudinal intervals.

The preferred embodiment of the ladder holder 100 as in FIGS. 2-5 includes two parallel plates 102 that are laterally opposed and which define the lateral boundaries of the ladder holder. The plates are vertical and positioned perpendicularly to the vertical plane of the retaining wall 1 when the device 100 is mounted to the wall in a mounted position. Furthermore, the plates are aligned with one another such that a laterally-centered vertical plane, perpendicular to the vertical plane of the wall, divides the ladder holder into two symmetrical halves. The plates are spaced apart such that the distance between innermost surfaces 104 of the plates is less than a length of one of the rungs.

Each one of the plates 102 comprises a main portion 106. The main portion has a rear edge 108 that spans a full height of the main portion between a top and a bottom thereof and is parallel to the vertical plane of the wall 1. The rear edge provides support against the wall.

The ladder holder 100 also includes two laterally disposed bars, an upper one 110 and a lower one 112, spaced vertically from one another. The bars span between the innermost surfaces 104 of the main portions 106 and are perpendicular to the main portions. The upper bar is the near the top of the main portion, and the lower bar is located near the bottom thereof. Each bar has a wall engaging edge 114 spaced rearward from the rear edge 108 of the main portion. These wall engaging edges of each bar collectively define a wall engaging surface 115 of the ladder holder 100. The wall engaging edge of each bar is arranged to engage the corrugated panel 2 of the retaining wall 1 so as to support the holder in fixed relation to the wall regardless of where the holder is set. The wall engaging edges 114 thus define an upstanding plane of the mounting portion for butting engagement with the inner surface of the wall 1 where this upstanding plane is arranged to lie parallel to the vertical plane of the wall in the mounted position.

Each one of the plates 102 further includes a hook portion 116. The hook portion is coupled at a top of the main portion 106 and has a general inverted U shape. Collectively, the hook portion coupled with the main portion define the mounting portion 117 of the ladder holder 100 that is arranged for coupling the holder in fixed relation to the wall 1 in the mounted position as in FIG. 3. The hook portion has a first portion 118, upper portion 120, and a second portion 122.

The first portion 118 of the hook portion 116 is coupled to the top of the main portion 106 and extends upwards from the top thereof. This first portion has a recessed edge 124 that has two distinctive edges, one of which is a lower edge 126. The lower edge extends upwards and forwards from a start at a top of the rear edge 108 of the main portion to an end at an innermost portion 128 of the recessed edge. This lower edge is arranged to guide the top beam 4 upward into the innermost region of the recessed edge prior to manoeuvering this top beam into an uppermost region 130 of the hook portion. The second of the edges is an upper edge 132 that starts at a top end of the lower edge at the innermost portion of the recessed edge. The upper edge extends rearwards and upwards from this starting point to an end at a top end of the upper edge. Furthermore, the upward extent of the upper edge is less than the upward extent of the lower edge. This upper edge is arranged to guide the top beam 4 rearward from the innermost portion 128 of the recessed edge 124 into the uppermost region 130 of the hook portion 116. Overall, the recessed edge is arranged for moving the top beam into the uppermost portion so as to avoid engagement of the upper 120 and second 122 portions of the hook portion.

The first portion 118 further comprises a first clamping edge 134 which is above the recessed edge 124. The first clamping edge extends upwards from the top end of the upper edge 132 of the recessed edge and is vertically aligned with the rear edge 108 of the main portion 106 so as to lie in a common plane parallel to the vertical plane of the wall 1. Collectively, the first clamping edges of the two plates 102 define a first clamping surface 136. The purpose of the first clamping edge is to frictionally engage the inner surface 8 of the top beam 4 when the holder 100 is in the mounted position.

The hook portion 116 also includes an upper portion 120 that extends rearward from the first portion 118 above the first clamping edge 134 and above the recessed edge 124. The upper portion comprises a bottom edge 138 that meets a top end of the first clamping edge substantially at a right angle. The bottom edge is arranged to engage a top beam surface 14 of the top beam 4 to provide support when the holder 100 is in the mounted position.

Furthermore, the hook portion 116 has second portion 122 extending downward from the upper portion 120 at a rearmost end of the upper portion, spaced rearward from the first portion 118. The second portion comprises an inner edge 140 opposite the first clamping edge 134 and recessed edge 124 of the first portion. The second portion supports a screw 142 threaded through the second portion proximate the bottom edge 138 of the upper portion, across from the first clamping edge and above the recessed edge of the first portion. Furthermore, the screw has a tip which protrudes from the inner edge towards the first clamping edge. The tip of the screw is movable so as to vary a distance between the tip and the first clamping edge. The tip is arranged to frictionally engage a portion of the outer surface 10 of the top beam 4. Together, the tips of the screws of the two plates define a second clamping surface 146. Furthermore, the second clamping surface and the first clamping surface 136 collectively define a retaining mechanism 148 that prevents upward lifting through frictional engagement of respective inner 8 and outer 10 surfaces of the wall 1 when the holder 100 is in the mounted position.

Additionally, the second portion 122 has a lip 150 protruding horizontally from the inner edge 140. The lip is located across from the recessed edge 124 of the first portion 118 and is spaced below the bottom edge 138 of the upper portion 120, below the screw 142 of the second portion 122, and below the first clamping edge 134 of the first portion 118. The lip forms a horizontal shoulder 152 at a right angle with the inner edge of the second portion. The lip extends from shoulder at the inner edge to an end at a tip of the lip. Then, the tip of the lip tapers off downward and rearward towards a bottom edge 156 of the second portion. The shoulder of the lip is arranged to engage the bottom edge 6 at the outer surface 10 of the top beam 4 so as to help in retaining the holder 100 to the wall 1 if the retaining mechanism 148 fails to frictionally engage the top beam to a sufficient degree. The taper of the lip guides the top beam around the shoulder thereof.

Figure 6:
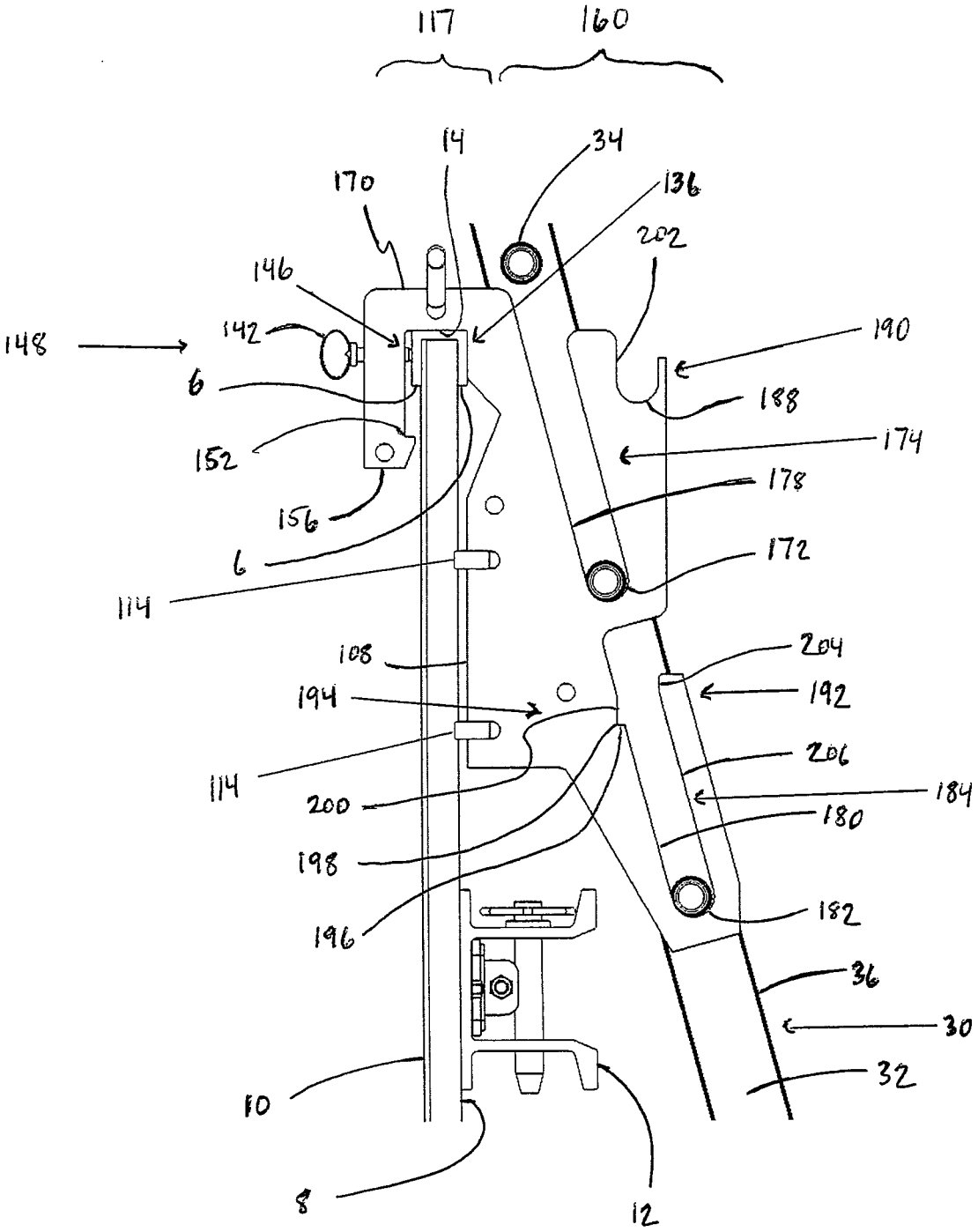
FIG. 6 is a left elevation view of the cross section of the ladder holder of FIG. 2 mounted to the retaining wall and supporting a ladder in the working position.

Each one of the plates 102 also includes a front portion 158 that extends forward from a front of the main portion 106 and downward below the bottom of same. The bottom of the main portion is above a lowest region of the front portion so as to provide clearance for the support bracket 12 when the holder is in the mounted position. The front portions of each plate collectively define a support portion 160 of the ladder holder 100, which supports the ladder 30 thereon. Each front portion comprises three individual slots presented as a first 162, second 164, and third 166. The first individual slot starts at an opening 168 forward from the upper portion 120 of the hook portion 116 at a top end of the plate. The opening of the first slot is at the same elevation as a top edge 170 of the upper portion, which is opposite the bottom edge 138 of same. The first slot is elongate and extends downwards and forwards at a fixed angle relative to the vertical plane of the inner surface 8 of the wall 1 from the opening at a top end of the first slot to a terminal end 172 at the bottom of same. The terminal end of the first slot is below the recessed edge 124 of the first portion 118, below the upper bar 110, yet above the lower bar 112. Furthermore, this terminal end is forward of the main portion 106. The first slots of each plate collectively define an upper slot 174 which is arranged to support a single rung 34 when the ladder 30 is in a working position as illustrated in FIG. 6, in which the ladder is mounted relative to the wall 1 at the fixed angle. The terminal ends of the first slots of the two plates 102 are aligned along a common horizontal rung axis that is parallel to the vertical plane of the wall.

The second individual slot 164 of the front portion 158 starts below the terminal end 172 of the first slot 162 with an opening 176 towards the front of the front portion. The opening of the second slot is forwards of the main portion 106, above the bottom of the main portion, yet below the hook portion 116 and the upper bar 110. The second slot is elongate and extends downwards and forwards at the fixed angle of the first slot such that a rear edge 178 of the first slot and a rear edge 180 of the second slot lie in a common plane at the fixed angle. The second slot starts at the opening 176 at a top of the second slot and ends at a terminal end 182 at a bottom of the second slot. The terminal end of the second slot is spaced forward from the terminal end 172 of the first slot 162 and is below the bottom of the main portion 106. The second slots of each plate 102 collectively define a lower slot 184 that is arranged to receive a single rung 34 when the ladder 30 is in the working position as shown in FIG. 6. The terminal ends 182 of the second slots of the two plates are aligned along a common horizontal rung axis that is parallel to the vertical plane of the wall 1, this horizontal axis being lower than and forward from the horizontal axis through the first slots 162 of the two plates. The positions of the terminal ends 172 of the first slot and the terminal ends 182 of the second slot of each plate being lower than the hook portion 116 and proximate in elevation to the respective upper 110 and lower 112 bars increases the stability of the holder 100 in the mounted position.

Figure 7:
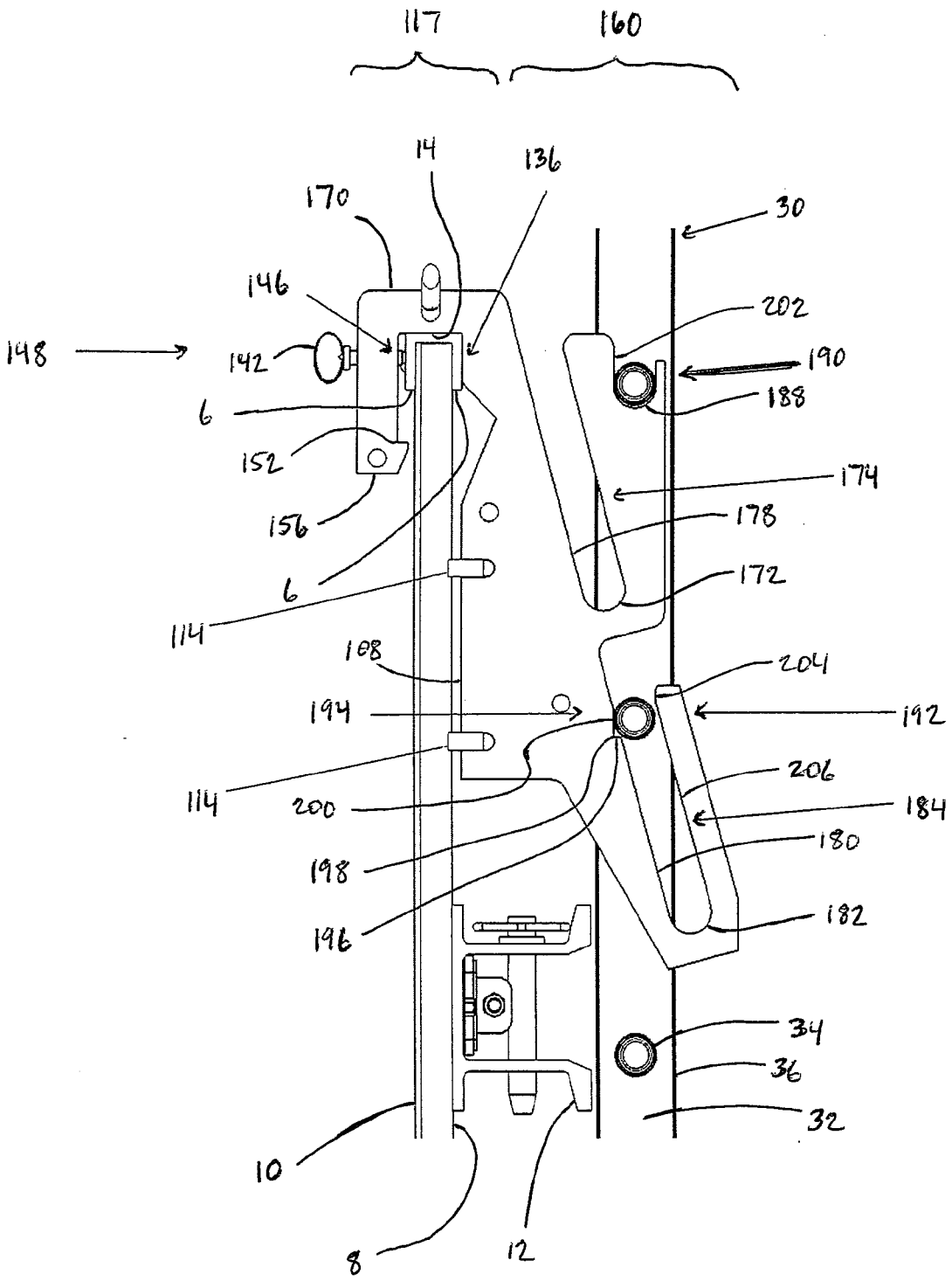
FIG. 7 is a left elevation view of the cross section of the ladder holder of FIG. 2 mounted to the retaining wall and supporting a ladder in the storage position.

The front portion 158 further includes a third individual slot 166. The third slot starts at an opening 186 forward of the opening 168 of the first slot 162, at the same elevation as same, and ends at a terminal end 188 at a bottom of the third slot. The distance between a top end of the front portion, joining the opening of the first slot and the opening of the third slot, and a top edge of the opening of the second slot is slightly less than the spacing between adjacent rungs so that adjacent rungs can be simultaneously inserted into the openings of respective upper and lower slots. The third slot extends downwards for less than one-third of the length of the first slot and in a direction that is parallel to the rear edge 108 of the main portion 106. The terminal end of the third slot is spaced above the terminal end 172 of the first slot. The distance of the third slot from the vertical plane of the wall 1 is near the depth of the support bracket 12 from the inner surface 8 of the wall. The third slots of each plate 102 collectively define a storage slot 190 that is arranged to receive a single rung 34 such that the ladder 30 is suspended vertically in a storage position as illustrated in FIG. 7 and so that the ladder overlaps the support bracket. These thirds slots lie along a horizontal axis parallel to the wall and above both of the horizontal axes through respective first slots 162 and second slots 164 of the two plates.

Adding to the functionality of the storage slot 190, the second slot 164 has an upper portion 192 proximate the opening 176 of the second slot. This upper portion has a recessed edge 194 recessed rearward from the rear edge 180 of the second slot. The recessed edge of the second slot has two edges. A first of the edges is a bottom edge 196 that starts at the rear edge of the second slot and extends rearward at a right angle to the vertical plane of the wall 1 to a terminal end at a shoulder 198 of the recessed edge. A second of the edges of this recessed edge is a vertical edge 200 which starts at the shoulder of the recessed edge and extends upwards to a terminal end at the opening 176 of the second slot. The vertical edge is vertically aligned with a rear edge 202 of the third slot 166 in a common plane parallel to the vertical plane of the wall. Furthermore, a vertical portion 204 of a front edge 206 of the second slot which is opposite the vertical edge 200 of the recessed edge 194 and above the terminal end thereof allows a rung 34 to be manoeuvered into the upper portion 192 of the second slot in the storage position of the ladder 30 as shown in FIG. 7. The recessed edge of the second slot in combination with the vertical portion of the front edge of the second slot are arranged to restrict the movement of another rung in the storage position of the ladder.

Each plate 102 has two portions of different thickness, where thickness is measured laterally between the innermost surfaces 104 and outermost surfaces 208 of the plates: a thick portion of the plates includes the hook portion 116 and mounting portion 117, and a thin portion includes the support portion 160. The thickness of the thin portion is offset laterally inward relative to the thickness of the thick portion, creating a stepped profile in the outermost surfaces of the plates and forming a shoulder where the change in thickness is introduced. As such, the stepped profile is created by reducing the distance between the outermost surfaces of the plates at the thin portion compared to the thick portion, while the distance between the innermost surfaces 104 of the places is fixed throughout. At the thick portion, the distance between outermost surfaces of the plates is greater than the length of a rung 34, near the distance between outermost surfaces of each of the rails 32. The distance between the outermost surfaces of the plates at the thin portion is less than a length of a rung but greater than the distance between the innermost surfaces of the plates 102.

Each plate 102 further comprises a set of guide surfaces extending laterally from the outermost surfaces 208 at the support portion 160. These guide surfaces make use of the shoulder of the stepped profile of the outermost surfaces. The set of guide surfaces on each plate includes two types, the first of which is an inclined guide surface 212. The inclined guide surface is parallel to the rear edge 178 of the first slot 162 and is spaced rearward therefrom by a distance that is near the distance between an edge of the rung 34 nearest a longitudinal edge 36 of the rail 32 to this longitudinal edge. The inclined guide surface starts from a top end of the holder 100, at the top edge 170 of the upper portion 120 of the hook portion 116, and ends at a terminal end above the top end of the vertical edge 200 of the recessed edge 194 of the second slot 164. The terminal end of the inclined guide surface is spaced rearward from this vertical edge at the same distance between the inclined guide surface and the rear edge 178 of the first slot 162. The inclined guide surface is arranged for sliding engagement of one of the rails 32, when a rung 34 is sliding in the first slot, in the working position of the ladder 30.

The set of guide surfaces also includes a vertical guide surface 214 which extends downward from the terminal end of the inclined guide surface 212 to the bottom of the front portion 158. The vertical guide surface is parallel to the wall engaging edges 114 of the upper 110 and lower 112 bars and is forward of the main portion 106. Further, this vertical guide surface is spaced rearward from the recessed edge 194 of the upper portion 192 of the second slot 164 near the distance from the edge of the rung 34 nearest the longitudinal edge 36 of the rail 32 to this longitudinal edge. Furthermore, the vertical guide surface is arranged for sliding engagement of one of the rails, when a rung is sliding in the third slot 166, in the storage position of the ladder 30.

The two plates 102 are coupled by three cylindrical rods. The rods span laterally between the innermost surfaces 104 of the plates and are perpendicular relative to the plates. A first connecting rod 216 is located proximate the top of the main portion 106, above the upper bar 110, below the recessed edge 124 of the first portion 118, and forward of the rear edge 108 of the main portion. This first connecting rod is arranged to couple the main portion of each plate. A second connecting rod 218 is positioned to the rear of the opening 176 of the second slot 164, rearward from the vertical guide surface 214 and below the inclined guide surface 212 at the same elevation as a point where there two types of guide surfaces converge, yet above the lower bar 112. The second connecting rod is positioned so as to not interfere with the rails 32 of the ladder 30 during sliding engagement with the guide surfaces. The second connecting rod is arranged to couple the front portion 158 of each plate rearward of the shoulder of the outermost surfaces 208, where the plate has greater thickness and consequently is stronger. A third connecting rod 220 is located to the rear of the lip 150 of the second portion 122, below the shoulder 152 joining the inner edge and the tip of the lip at a point about halfway between this shoulder and the bottom edge 156 of the second portion. The third connecting rod is arranged to couple the second portion of the hook portion 116 of each plate 102 where the hook portion will endure the most tensile strain in the scenario that the lip engages the bottom edge 6 at the outer surface 10 of the top beam 4. As such, each one of the connecting rods couples each one of the three main subcomponents of the ladder holder 100, and together the rods rigidify the structure whilst allowing the ladder holder to remain lightweight.

The ladder holder 100 also comprises a handle 222. The handle spans laterally between the upper portions 120 of the hook portions 116 of the two plates 102 and is arranged for lifting and aiding the mounting of the ladder holder onto the retaining wall 1. The handle has a central portion wide enough for grasping with a hand. The central portion is elevated relative to the top edges 170 of the upper portions so as to provide room to grasp the handle comfortably when the ladder holder is in the mounted position. The handle is arranged proximate the horizontal midpoint of the upper portions so as to be aligned with the center of gravity of the ladder holder in combination with the retaining wall.

In use, the ladder holder 100 must be mounted to the retaining wall 1 prior to mounting the ladder 30 to the holder. Mounting to the wall is accomplished by pivoting the holder relative to the wall so that the lower edge 126 of the recessed edge 124 of the first portion 118 is approximately parallel to the inner surface 8 of the top beam 4. Next, the holder is lowered onto the wall so as to navigate the top beam into the innermost portion 128 of the recessed edge. Then, the device is moved away from the inner surface of the wall while simultaneously pivoting the holder relative to the wall so as to bring the main body 106 towards same. The horizontal movement and pivoting of the holder manoeuvers the top beam towards the second portion 122 of the hook portion 116 such that the bottom edge 6 of the top beam is generally above the lip 150 of the second portion. Next, the device is moved downwards relative to the wall inserting the top beam in the uppermost region 130 of the hook portion so that the bottom edge 138 of the upper portion 120 engages the top beam surface 14, and the first clamping surface 136 engages the inner surface of the top beam. Finally, the screws 142 of the two plates 102 are simultaneously tightened so that the tips of the screws engage the outer surface 10 of the top beam as the second clamping surface 146. At this stage, the device is considered to be in the mounted position.

The method of mounting the ladder 30 to the ladder holder 100 is generally based on horizontally aligning adjacent rungs 34 with the openings of the storage and lower slots while ensuring that the ladder is laterally centered relative to the holder. More specifically, an upper rung is aligned with the openings 186 of the storage slot 190 so that an upper rung axis is aligned horizontally with an axis spanning laterally through the openings of the storage slot so as to lie in a common horizontal plane, and a lower slot is aligned with the openings 176 of the lower slot 184 so that a lower rung axis is aligned horizontally with an axis spanning laterally through the openings of the lower slot so as to lie in a common horizontal plane. At this instant, the ladder may be substantially vertical or may be pivoted to be at the fixed angle of the inclined guide surfaces 212. Assuming that the ladder was initially vertical, the vertical guide surfaces will be engaged first, at which point the upper rung will be in the vicinity of the openings of the 186 of the storage slot 190 and the lower rung will be in the openings 176 of the lower slot 184 in an intermediate vertical position. From this intermediate vertical position, the ladder can be arranged in the working position by pivoting the top of the ladder towards the top of the holder about the lower rung until the rails 32 engage the inclined guide surfaces 212. Then, the ladder is slid downwards against the inclined guide surfaces so that the upper rung is inserted into the upper slot 174 and a second rung is placed within the lower slot. Alternatively, to suspend the ladder in the storage position immediately from the intermediate vertical, the ladder is slid downwards position against the vertical guide surfaces so that the first rung is in the storage slot 190 and the second rung is in the upper portions 192 of the lower slot.

In a second scenario in which the ladder 30 is initially pivoted relative to the ladder holder 100 so as to be oriented upright yet at the fixed angle of the inclined guide surfaces 212, moving the ladder towards the holder will result in the rails 32 contacting the inclined guide surfaces, at which point the upper rung will be in the vicinity of the openings of the 168 of the upper slot 190 and the lower rung will be in the openings 176 of the lower slot 184 in an intermediate pivoted position. From this intermediate pivoted position, the ladder can be arranged in the working position by sliding the ladder downwards against the inclined guide surfaces so that the upper rung is inserted into the upper slot 174 and a second rung is placed within the lower slot.

Regardless of the current position of the ladder 30 once same is mounted to the holder 100, the ladder can be moved between the working and storage positions without dismounting same. A ladder position may be changed by first sliding the ladder upwards until the lower rung engages rear edges of the openings 176 of the lower slot 184. Then, the ladder may be pivoted about the lower rung in a direction towards the upper slot to place the ladder in the working position or in a direction towards the storage slot to arrange the ladder in the storage position.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A ladder holder in combination with a ladder for mounting the ladder in an upright orientation relative to a wall having an inner surface lying in a vertical plane, in which the ladder comprises two rails extending longitudinally and a plurality of rungs spanning laterally between the rails at uniform longitudinal intervals, the holder comprising:

a mounting portion arranged for coupling in fixed relation to the wall in a mounted position;

the mounting portion defining an upstanding plane for butting engagement with the inner surface of the wall where the upstanding plane is arranged to lie parallel to the vertical plane of the wall in the mounted position;

a support portion supported fixedly on the mounting portion, the support portion including:

a pair of first slots on opposite lateral sides of the support portion arranged to receive one of said plurality of rungs;

a plurality of first ladder supporting features cooperative with the pair of first slots to position the ladder in fixed position at a prescribed angle relative to the upstanding plane of the mounting portion;

the first ladder supporting features comprising at least one of (i) a pair of inclined surfaces extending longitudinally of the ladder in the working position which receive the two rails of the ladder in the working position, and (ii) a pair of second slots on said opposite lateral sides of the support portion which in the working position receive one of said plurality of rungs different from that received in the pair of first slots;

a pair of storage slots on said opposite lateral sides of the support portion arranged to receive one of said plurality of rungs in a position of the ladder different from the working position;

the pair of storage slots being located on the support portion so that in the working position of the ladder the pair of storage slots is at a spaced location away from the ladder;

and a plurality of second ladder supporting features cooperative with the pair of storage slots to position the ladder in fixed position with a substantially vertical orientation generally parallel to the upstanding plane of the mounting portion;

the second ladder supporting features comprising at least one of (i) a pair of upright surfaces extending longitudinally of the ladder in the storage position which receive the two rails of the ladder in the storage position, and (ii) upper portions of the first slots which in the storage position receive one of said plurality of rungs different from that received in the pair of the storage slots.

2. The ladder holder according to claim 1, wherein the mounting portion includes a wall engaging surface arranged to engage the inner surface of the wall that comprises at least one continuous surface spanning laterally across a full width of the mounting portion.

3. The ladder holder according to claim 2, wherein said at least one continuous surface comprises two lateral cross members spaced vertically from one another.

4. The ladder holder according to claim 1, wherein the mounting portion comprises a retaining mechanism for preventing upward lifting in the mounted position.

5. The ladder holder according to claim 4, wherein the mounting portion has a front side portion having a first clamping surface arranged to engage the inner surface of the wall and an opposing backside portion supporting a second clamping surface that is moveable with respect to the first clamping surface and is arranged to engage the outer surface of the wall in the mounted position, the first and second clamping surfaces defining the retaining mechanism.

6. The ladder holder according to claim 5, wherein the second clamping surface is defined by two screws laterally spaced and threaded through the backside portion.

7. The ladder holder according to claim 1, wherein the wall is a retaining wall used in ground excavation and has a top beam at an uppermost edge of the wall, and wherein the mounting portion has a front side portion, an opposing backside portion, an upper portion arranged to couple the front side portion and the backside portion over the top beam such that the hook is formed by the front side portion and the backside portion and the upper portion, and a lip protruding from the backside portion towards the front side portion spaced below the upper portion.

8. The ladder holder according to claim 1, wherein the wall is a retaining wall used in ground excavation, the retaining wall having a laterally oriented elongate support bracket below a top beam at an uppermost edge of the wall such that the support bracket has a ladder-side surface arranged for facing away from the inner surface of the retaining wall, and wherein the storage slot is arranged at a distance from the vertical plane of the inner surface of the wall proximate the distance between the ladder-side surface of the support bracket and the inner surface of the wall such that rearward surfaces of the two rails of the ladder substantially overlap the ladder-side surface in the storage position.

9. The ladder holder according to claim 1, wherein the support portion comprises two laterally opposite side plates, wherein each one of the pair of the first slots is disposed in each side plate.

10. The ladder holder according to claim 1 wherein the pair of storage slots is located on the support portion such that in the working position of the ladder the pair of storage slots is spaced above the pair of first slots in a direction longitudinally of the ladder in the substantially vertical orientation.

11. The ladder holder according to claim 1 wherein the first ladder-supporting features are located on the support portion such that in the working position of the ladder the first ladder-supporting features are spaced from the pair of first slots in a direction longitudinally of the ladder at the prescribed angle.

12. The ladder holder according to claim 1 wherein the first ladder supporting features include the pair of inclined surfaces.

13. The ladder holder according to claim 1 wherein the first ladder supporting features include the pair of second slots.

14. The ladder holder according to claim 1 wherein the second ladder supporting features include the pair of upright surfaces.

15. The ladder holder according to claim 1 wherein the second ladder supporting features include the upper portions of one of the first slots and the second slots.

16. The ladder holder according to claim 15 wherein said upper portions of one of the first slots and the second slots include the upper portions of the first slots, the pair of first slots being located below the pair of second slots and further away from the upstanding plane of the mounting portion.

* * * * *